US011318364B2

(12) United States Patent
Slagter et al.

(10) Patent No.: US 11,318,364 B2
(45) Date of Patent: May 3, 2022

(54) SKATEBOARD AND SKATEBOARD TRUCKS FOR SIMULATING SURFING

(71) Applicant: MTMX Corporation, inc., Santa Barbara, CA (US)

(72) Inventors: Mark Andrew Slagter, Palos Verdes Estates, CA (US); Carl Victor deCiutiis, Rancho Palos Verde, CA (US)

(73) Assignee: MTMX, LLC, Santa Barbara, CA (US)

( * ) Notice: Subject to any disclaimer, the term of this patent is extended or adjusted under 35 U.S.C. 154(b) by 0 days.

(21) Appl. No.: 16/922,867

(22) Filed: Jul. 7, 2020

(65) Prior Publication Data

US 2021/0008437 A1 Jan. 14, 2021

Related U.S. Application Data

(60) Provisional application No. 62/921,798, filed on Jul. 8, 2019.

(51) Int. Cl.
*A63C 17/00* (2006.01)
*A63C 17/01* (2006.01)

(52) U.S. Cl.
CPC ..... *A63C 17/0093* (2013.01); *A63C 17/012* (2013.01); *A63C 17/015* (2013.01)

(58) Field of Classification Search
CPC ..... A63C 17/0093; A63C 17/012
See application file for complete search history.

(56) References Cited

U.S. PATENT DOCUMENTS

| | | | | |
|---|---|---|---|---|
| 4,245,848 | A | 1/1981 | Dudouyt | |
| 6,315,304 | B1 * | 11/2001 | Kirkland | A63C 17/01 280/11.28 |
| 7,219,907 | B2 * | 5/2007 | Chang | A63C 17/0093 280/11.225 |
| 7,316,408 | B2 | 1/2008 | McClain | |
| 8,328,206 | B2 | 12/2012 | Williams, Jr. | |
| 8,783,699 | B2 * | 7/2014 | Gesmer | B60B 27/0005 280/87.042 |
| 10,335,667 | B2 * | 7/2019 | Martinez Almansa | A63C 17/015 |
| 2001/0038187 | A1 * | 11/2001 | Reyes | A63C 17/01 280/87.042 |

(Continued)

*Primary Examiner* — Brian L Swenson
(74) *Attorney, Agent, or Firm* — Ferguson Case Orr Paterson LLP

(57) ABSTRACT

Skateboard trucks and skateboards using the improved trucks are disclosed. Truck according to the present invention can comprising a hanger with wheels. A base assembly is included having an at least partially hollow housing section. The hanger is rotationally mounted to the base assembly. The hanger also comprises a hanger portion that is within partially hollow housing section. Compressible spring elements are included within the partially hollow housing section, wherein the hanger portion operates on the compressible spring elements when the hanger rotates in relation to the base assembly. Skateboard are also disclosed that utilize the truck. One or more trucks are mounted to the skateboard deck with the truck having internal compressible spring elements that are compressed when turning the skateboard. The internal compressible spring elements also expand to return the truck to a neutral position when the skateboard is not turning.

19 Claims, 5 Drawing Sheets

EXPLODED VIEW 3

(56) References Cited

U.S. PATENT DOCUMENTS

| | | | | |
|---|---|---|---|---|
| 2002/0011713 | A1* | 1/2002 | Kirkland | A63C 17/012<br>280/11.28 |
| 2005/0012290 | A1* | 1/2005 | McClain | A63C 17/01<br>280/87.042 |
| 2007/0164530 | A1* | 7/2007 | Horn | A63C 17/01<br>280/87.042 |
| 2011/0210526 | A1* | 9/2011 | Williams, Jr. | A63C 17/0093<br>280/11.28 |
| 2013/0069331 | A1* | 3/2013 | Yamada | A63C 17/0093<br>280/87.042 |
| 2015/0097352 | A1 | 4/2015 | Ivazes | |

* cited by examiner

EXPLODED VIEW 3

EXPLODED VIEW 4

RUBBER SPRING DIAGRAM

Rubber Spring Diagram

Rubber Spring Diagram 10°

Rubber Spring Diagram 30°

ROTATIONAL LIMIT DIAGRAM
20
21
24
46
C
C

C-C (1:2)
42
46
48
50

NEUTRAL POSITION

10 DEGREE TURN

MAXIMUM TURNING ANGLE

SKATEBOARD AND SKATEBOARD TRUCKS FOR SIMULATING SURFING

This application claims the benefit of U.S. Provisional Patent Application Ser. No. 62/921,798, filed on Jul. 8, 2019.

BACKGROUND OF THE INVENTION

Field of the Invention

This invention is directed towards the field of recreational and exercise vehicles and in particular, skateboards and mechanisms used in skateboards.

Description of Related Art

The sport of skateboarding first started when surfers took the trucks and wheels off of roller-skates and screwed them to a piece of plywood to try to simulate surfing on pavement, even though the surfaces of water and pavement are very different. A surfboard has curvature to the bottom plane of the board called rocker and shaped side rails. The rider carves turns through the water by balancing properly above the surfboard, tilting over the surfboard, submerging the rail into the water, and allowing the rocker to create the arc of a turn. The fin/fins of a surfboard, which are located towards the back bottoms-side of the board where there is less rocker help to keep the board from skipping on top of the water. By shifting weight side to side and front to back, the surfer is able to turn, accelerate and stall the surfboard to control his position in the water.

Conventional skateboard and skateboard truck mechanisms crudely simulate surfing. By tilting the skateboard deck in a similar fashion as surfing, the rider is able to turn the font wheels of the board in the direction of the "tilt" and the back wheels in the opposite direction, thusly carving a more regular arc shaped path along the pavement. Polyurethane wheels grip the pavement to help keep the skateboard from sliding during a turn. Conventional skateboard trucks can be provided with a mechanism that for the trucks to be tightened or loosened, which results in the skateboard requiring more or less tilt force to turn the skateboard.

The modern evolution of skateboarding has veered from its origins of simulating surfing into two major directions, both having less to do with carving turns, and more to do with skateboard tricks performed in bowls and on sidewalk street skating. Most of the tricks are performed with the skateboard trucks cranked tight which limits the amount of turning capabilities and gives riders more stability for "landing" a variety of tricks, many of which involve the skateboard leaving with the ground.

More recently a trend in longboarding has arisen which is less focused on the ability to do flip tricks, and more on the original concept of carving turns and simulating surfing. A few recent inventions such as the Carver, Gullwing and Rojas have developed skateboard trucks that allow greater mobility. Many of these new devices (as well as the common skateboard truck design) have a problem with wheel bite, whereby the front wheels come in contact with the skateboard deck creating an instant stop usually resulting in a dangerous situation where the rider falls. This problem is normally solved by tightening down the truck and limiting its turning ability, or by putting spacers between the deck and truck resulting in a board that is extremely high off the ground with a high center of gravity and high level of instability.

SUMMARY OF THE INVENTION

The present invention is directed to improved skateboard trucks and skateboards using the improved trucks. One embodiment of a skateboard truck according to the present invention comprising a hanger with wheels. The truck also comprises a base assembly having an at least partially hollow housing section, with the hanger rotationally mounted to the base assembly. The hanger comprises a hanger portion that is within partially hollow housing section. Compressible spring elements are included within the partially hollow housing section, wherein the hanger portion operates on the compressible spring elements when the hanger rotates in relation to the base assembly.

Another embodiment of a skateboard truck according to the present invention comprises a hanger rotatably mounted to a base assembly. Spring elements are included that are internal to the base assembly, wherein a turning force on the hanger causes the hanger to rotate in relation to the base assembly. This in turn causes compression of the internal spring elements. Removal of the turning force then allows the spring elements to expand to cause the hanger to return to a neutral position in relation to the base assembly.

One embodiment of a skateboard according to the present invention comprises a skateboard deck with a front kickplate. A truck is mounted to the front kickplate with the truck having internal compressible spring elements that are compressed when turning the skateboard. The internal compressible spring elements also expand to return the truck to a neutral position when the skateboard is not turning.

Other advantages of this invention will become apparent from the following description taken in junction with the accompanying drawings wherein are set forth, by way of illustration and example, certain embodiments of this invention. The drawings constitute a part of this specification and include exemplary embodiments of the present invention and illustrate various features thereof.

DETAILED DESCRIPTION OF THE INVENTION

Figure 2:
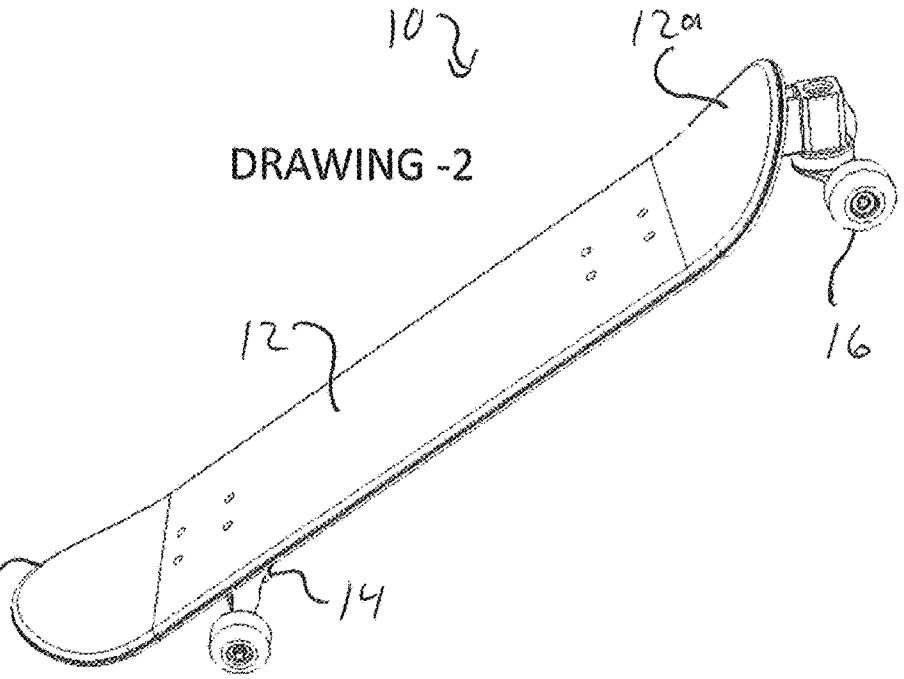
FIG. 2 is top perspective view of one embodiment of a skateboard according to the present invention

The present invention is generally directed to different embodiments of improved skateboard trucks and improved skateboards using those trucks. The trucks according to the present invention provide for a smoother, quieter and more gradual turning action compared to a conventional trucks. Some skateboards according to the present invention place one of these trucks closer to the nose of the skateboard deck. This provides certain advantages and discussed below including but not limited to, lowering the center of gravity By making this nose truck capable of more loosely turning, in conjunction with a stiffer standard back truck mounted, a skateboard is provided that has a closer feel to a surfboard and the lower center of gravity can provide easier use and greater stability. The skateboards and trucks according to the present invention can also provide other advantages as discussed below.

Some embodiment of a truck according to the present invention can provide improved operating characteristics by having internal compression and recoil mechanisms. Turning of the skateboard causes and internal compression action, and releasing of this turning force allows for the compression to be removed and the truck is returned to its neutral position. In some embodiment, the trucks can have internal compressible rods that provide this compression and recoil action. It is understood that many other components can be used to provide this compression and recoil mechanism.

The present invention can provide trucks used on skateboards that better simulate the feeling of surfing, and the unique carving arc that the rocker, rails, and fins of a surfboard create in water. The present invention can also provide a skateboard that gives the user the characteristics and ability of a shortboard to do tricks in bowls and sidewalk skating, as well as the carving ability of a longboard to simulate surfing. The present invention also provides a skateboard that permits the user a great deal of freedom to self-propel forward buy pumping the skateboard side to side and front to back in a similar fashion to how surfers gyrate their surfboard to accelerate or stall their surfboards. The skateboards according to the present invention also provide a skateboard with a low center of gravity which can allow improved turning ability while solving the problems associated with wheel bite.

Throughout this description, the preferred embodiment and examples illustrated should be considered as exemplars, rather than as limitations on the present invention. As used herein, the term "invention" or "present invention," refers to any one of the embodiments of the invention described herein, and any equivalents. Furthermore, reference to various feature(s) of the "invention" or "present invention," throughout this document does not mean that all claimed embodiments or methods must include the referenced feature(s).

It is also understood that when an element or feature is referred to as being "on" another element or feature, it can be directly on the other element or feature or intervening elements or features may also be present. It is also understood that when an element if referred to as being "attached," "connected" or "coupled" to another element, it can be directly attached, connected or coupled to the other element or intervening elements may be present. Relative terms, such as "above," "upper" or "lower," and similar terms, may be used herein to describe a relationship of one feature to another. It is understood that these terms are intended to encompass different orientations in addition to the orientation depicted in the figures.

Although the terms first, second, etc. may be used herein to describe various elements or components, these elements or components should not be limited by these terms. These terms are only used to distinguish one element or component from another element or component. Thus, a first element or component discussed below could be termed a second element or component without departing from the teachings of the present invention.

The terminology used herein is for describing particular embodiments only and is not intended to be limiting of the invention. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Embodiments of the invention are described herein with reference to different views and illustrations that are schematic illustrations of idealized embodiments of the invention. As such, variations from the shapes of the illustrations as a result, for example, of manufacturing techniques and/or tolerances are expected. Embodiments of the invention should not be construed as limited to the particular shapes of the regions illustrated herein, but are to include deviations in shapes that result, for example, from manufacturing.

Figure 1:
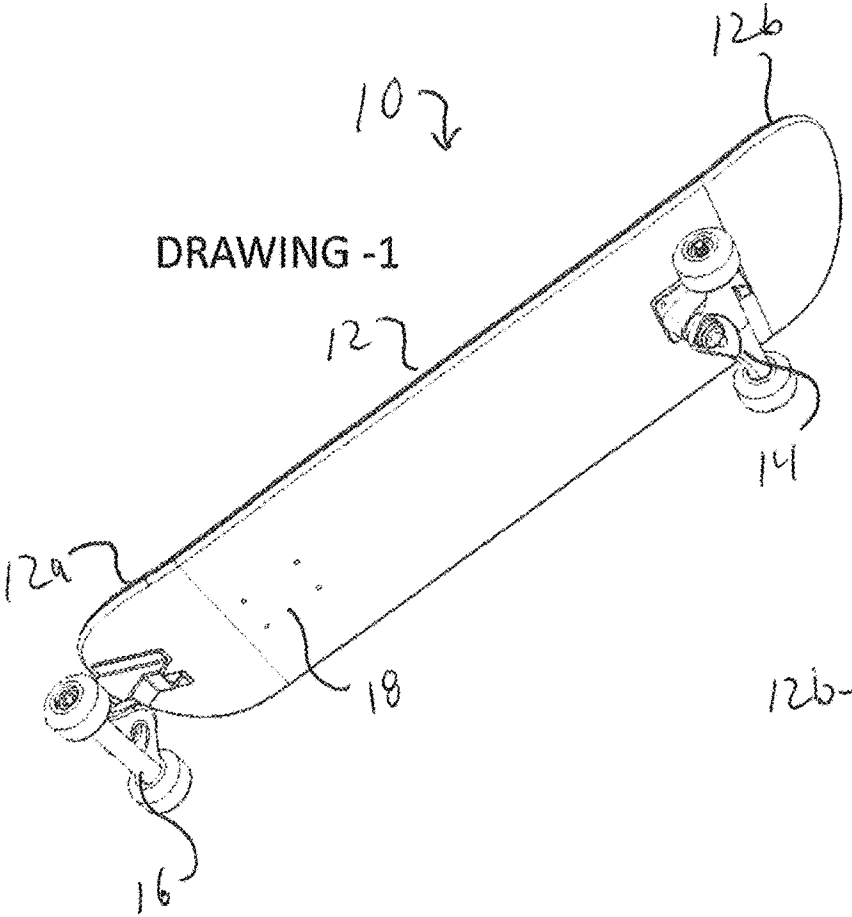
FIG. 1 is a bottom perspective view of one embodiment of a skateboard according to the present invention.
Figure 3:
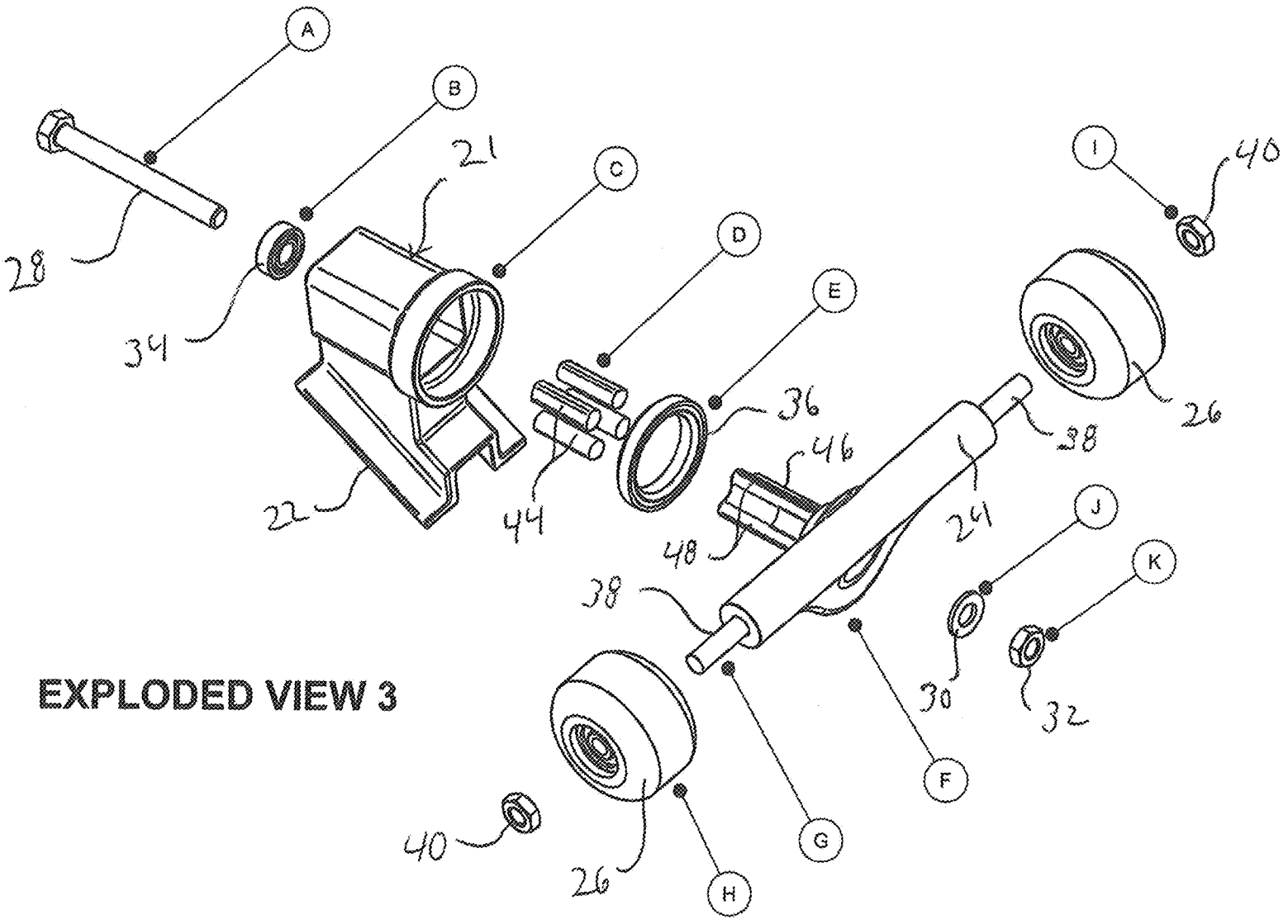
FIG. 3 is a bottom exploded view of one embodiment of a skateboard truck according to the present invention.

FIGS. 1 and 2 one embodiment of skateboard 10 according to the present invention that comprises a skateboard deck 12, with an angled front kickplate portion 12*a* and angled back kickplate portion 12*b*. The skateboard further comprises a back skateboard truck/wheel assembly ("back truck") 14 that can be a conventional truck/wheel assembly mounted in a standard position using conventional screws or bolts. The skateboard 10 can also comprise a front skateboard truck/wheel assembly ("front truck") 16 according to the present invention that is not mounted in the typical front location 18 but is instead mounted onto the front kickplate portion 12*a* of the skateboard. This particular inventive configuration and positioning better simulates the unique and irregular turning arc of a surfboard created by the rocker, rails and fins.

The positioning of the front truck 16 according to the present invention, along with the shape and of the front hanger and wheel arrangement of the front truck 16 according to the present invention (as described below} allow an improved turning radius of the device while still providing a skateboard having an lower center of gravity. By placing the truck assembly 16 on the front kickplate, the deck 12 near the front can be lower to the ground compared to conventional skateboards, which can result in the overall skateboard 10 having a lower center of gravity. In some embodiments, the skateboard deck 12 angles down slightly from the rear kickplate 12*b* to the front kickplate 12*a*. These characteristics can result in the skateboard 10 being more stable in uses such as skate park bowls, roads and sidewalks, compared to some conventional skateboards having a higher center of gravity as described above. The positioning of the front truck 16 on the front kickplate 12*a* also moves the front truck 16 closer to the front end of the deck 12, which increases the distance between the back truck 14 and front truck 16. This increases the wheelbase of the skateboard 10. This arrangement, when used in conjunction with a looser spring system in the front truck (as described below) gives provides a skateboard 10 with the carving qualities of a long board, the turning abilities and stability of a shortboard and the irregular arc carving qualities of a surfboard on water.

It is understood that in other skateboard embodiments, trucks can also be mounted on the back kickplate, with a conventional truck in the front mounted in a conventional location. In still other embodiments trucks can be mounted to both kickplates.

Figure 4:
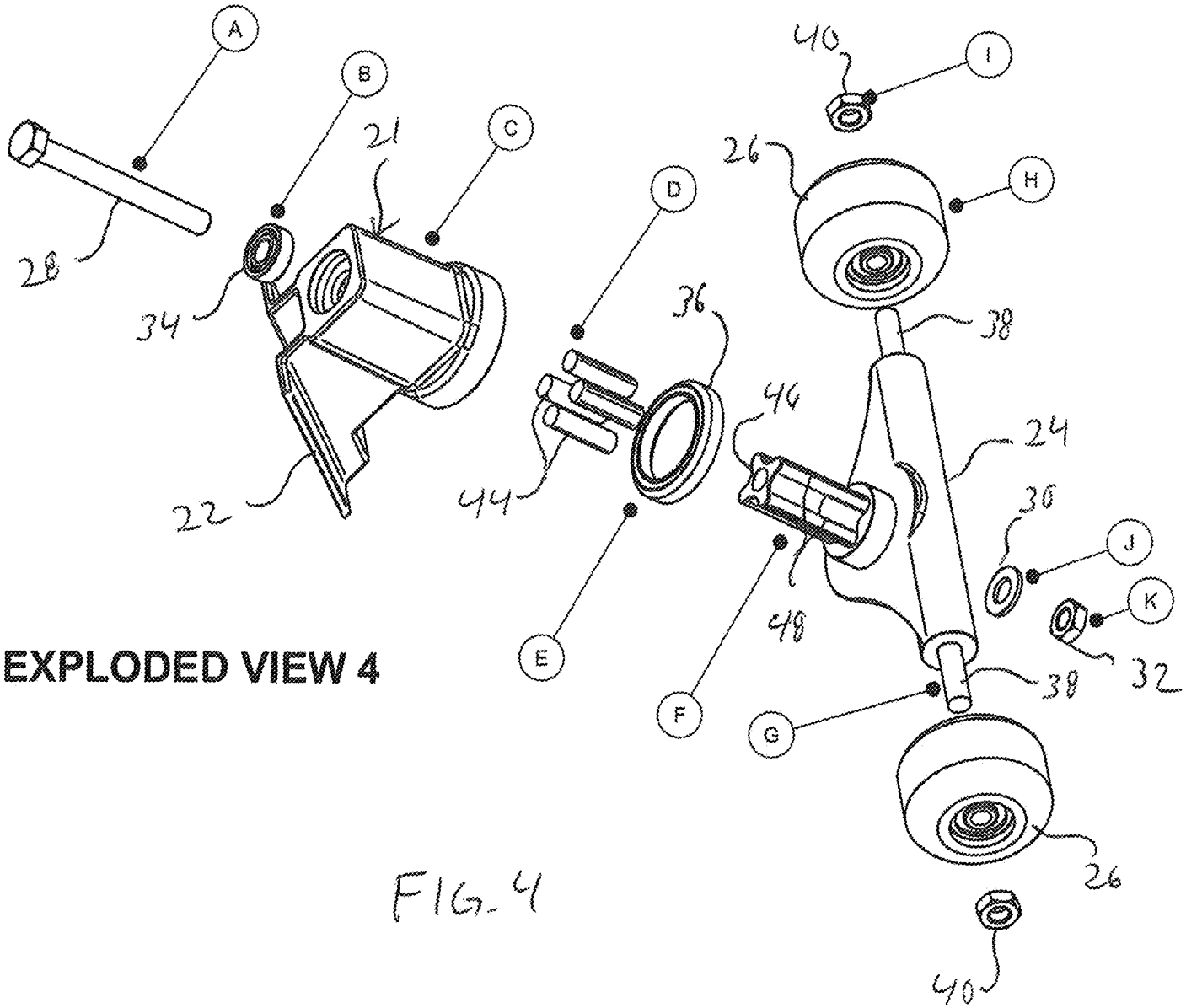
FIG. 4 is a top exploded view of one embodiment of a skateboard truck according to the present invention.
Figure 5:
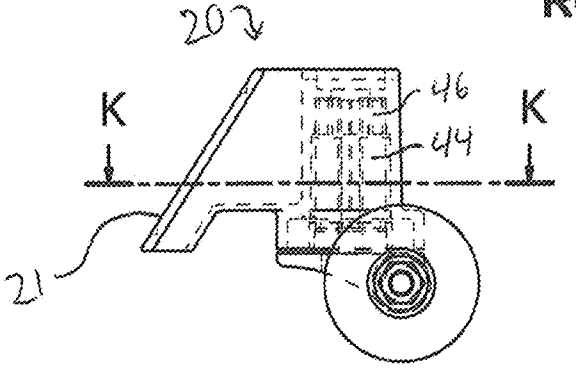
FIG. 5 is a side view of one embodiment of skateboard truck according to the present invention, with its internal or hidden components in phantom.

FIGS. 4 and 5 show one embodiment of truck 20 according to the present invention that comprises base assembly 21 that comprises a base plate 22 for mounting the truck 20 to an angled surface of a skateboard deck, such as to the front skateboard kickplate. It is understood, however, that other embodiments of the truck according to the present invention can comprise base plates arranged similar to those in conventional trucks. The truck 20 also comprises a hanger 24 and wheels 26, arranged so that when the truck is mounted on an angled surface of a skateboard deck, the hanger 24 and wheels 26 are positioned in the desired location to allow the wheels to roll on the ground when the skateboard is in use.

The truck 20 also comprises a bolt 28, washer 30 and nut 32 that cooperate to hold many parts of the truck 20 together. In the embodiment shown, the bolt 28 passes through the base assembly 21 and through a middle hole in the hanger 24. The washer 30 and nut 32 mate with a lower threaded portion of the bolt to hold the hanger 24 and base assembly 21 (as well as intervening components) together to allow the truck 20 to function as desired.

The truck 20 also comprises upper bearings 34 and lower bearings 36 to allow for smooth rotational movement between different parts of the truck 20. Different embodiments of the present invention can use different bearing arranged in many different ways and in different locations on the truck 20. In still other embodiments the truck can comprise other features to allow for smooth operation, such as various bushings or washers. In the embodiment shown, the upper hearing 34 has a smaller diameter than the lower bearing 36, with the upper bearing providing for smooth rotational movement between the head of the bolt 28 and the upper surface of the base assembly 21. The lower bearing 36 is arranged to provide for smooth rotational movement between the hanger 24 and the lower surface of the base assembly 21.

The wheels 26 are mounted on opposing ends of the hanger 24, with each of the wheels 26 having internal wheel bearings that ride on a respective one of the race portions 38 of the hanger 24. Nuts 40 mate with treaded portions of a respective one of the race portions 38 to hold the wheels 26 to the truck 20 in the desired location.

The base assembly 21 according to the present invention has a at least partially hollow housing 42 that in the embodiment shown has a square shaped cross-section. It is understood the hollow housing 42 can have many different cross-section shapes as described in more detail below. The truck 20 also comprises a plurality of rods 44, with different embodiments having different numbers of rods. Each of the rods 44 is positioned within the hollow housing 42, preferably with each of the rods 44 being positioned in corner of the hollow housing 42.

The hanger 24 also comprises a cam portion 46 that is arranged to extend into the hollow housing 42 to cooperate with the rods 44 to allow rotation and recoil of the hanger 24 is relation to the base assembly 21. In the embodiment shown, the cam portion 46 has a plurality of longitudinal walls 48, each of which is positioned between a respective pair of the rods 44. The embodiment shown comprises four rods, so the cam portion 46 also comprises four walls 48. As described in more detail below, as the hanger 24 turns, the walls 48 turn within the housing 42. This in turn causes each of the walls 48 to compress a respective one of the rods 42 between it and one of the inner surfaces of the hollow housing 42. This compression action provides the desired resistance to turning, and the compression of the rods continues until the hanger 24 reaches its maximum turning angle and stops. Once the turning force is removed, the compression force on the rods 42 is removed and the rods are allowed to expand. The expansion of the rods 42 causes the truck to return to its center or neutral position.

Each of the walls 48 is arranged to work on two of the rods 42. Each of wall 48 is between two rods 44, and when the hanger 24 turns one way each of the walls 48 compresses one of the rods 44 that it is between. When the hanger 24 turns the other way, it compresses the other of the rods 42 that it is between.

It is understood that different embodiments according to the present invention can use rods with different shapes and sizes, that can be made of different compressive materials. In some embodiments, the rods 42 can be made of material such rubber, polyurethane or other similar materials or combinations of materials. It is understood that the compressive nature (or hardness) of these materials is measured by a Shore/durameter hardness ("durameter hardness"). Durameter hardness is a measure of the resistance of a material to penetration.

For trucks according to the present invention where higher turning resistance is desired, rods with a higher durameter hardness can be used. This can be particularly applicable to skateboards used by a larger user where more turning force is used to compress the rods. Conversely, for trucks where a lower turning resistance is desired, rods with a lower durameter hardness can be used. This can be particularly applicable to skateboards used by smaller users where less turning force is used. It is understood that the different durameter hardness rods can be used based on other considerations beyond the size of the user, such as the desired operational characteristics of the skateboard.

It is also understood that different truck embodiments according to the present invention can be used with different numbers of rods arranged in different ways. In some embodiments, less than four rods can be used, while in other embodiments more than four can be used. The hollow housing for base assembly and the cam portion of the hanger can be shaped differently to accommodate the different numbers of rods.

The present innovative truck assembly relies on the action of compression to allow turning, and expansion and recoiling to return to neutral when the turning force is removed. This turning compression and expansion recoiling action can be provided by many different mechanisms, and the present invention should not be limited to the rod and cam section arrangement described above. The truck arrangements according to the present invention can be shorter that conventional trucks, which can provide alternative uses and applications for the trucks.

Figure 6:
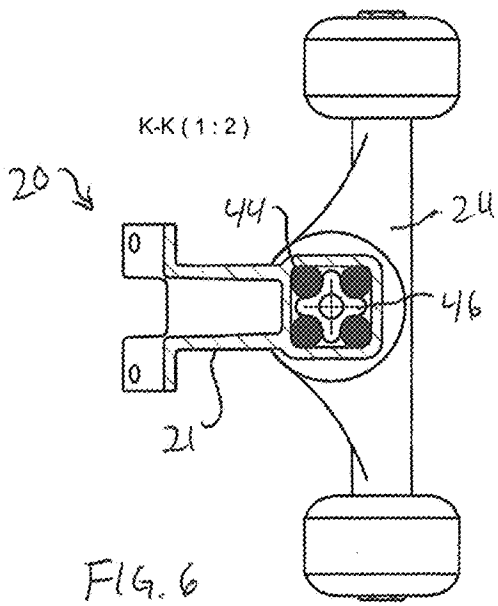
FIG. 6 is a top sectional view of the truck in FIG. 5 taken along second line K-K.

Referring now to FIGS. 5-10, the turning action of the trucks according to the present invention is shown in more detail. FIG. 5 a side view of a truck 20 according to the present invention with a section line K-K base assembly 21, rods 44 and cam section 46. FIG. 6 is a top section view of the truck 20 taken along section line K-K showing the truck 20 in its neutral position with the four rods 44 not compressed by the walls 48 of the cam section 46.

Figure 7:
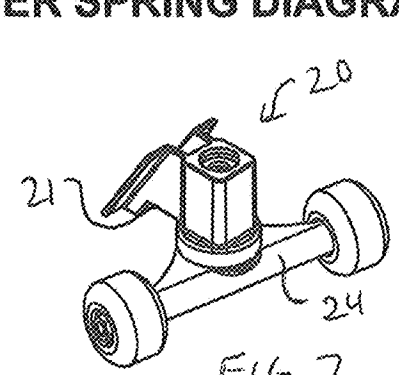
FIG. 7 is a perspective view of the truck in FIG. 5 at a 10-degree turn.
Figure 8:
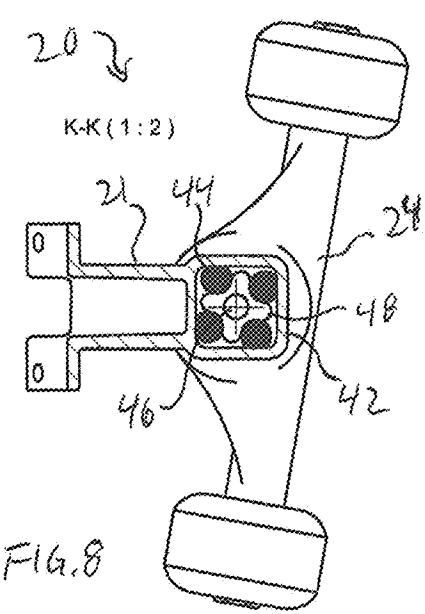
FIG. 8 is sectional view of the truck in FIG. 5 at a 10-degree turn, taken along section line K-K in FIG. 5.

FIG. 7 is a perspective view showing the truck 20 with the hanger 24 having a 10-degree turn in relation to the base assembly 21. Referring now to FIG. 8, the turning of the hanger 24 causes the cam section 46 to turn within the hollow housing 42. This in turn causes each of the walls 48 to compress a respective one of the rods 44 against an internal surface of the hollow housing 42.

Figure 9:
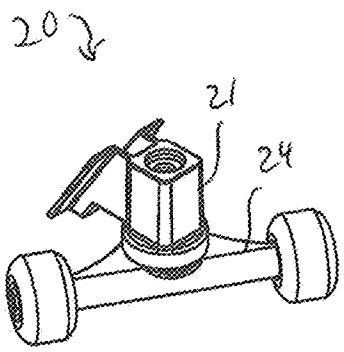
FIG. 9 is a perspective view of the truck in FIG. 5 at its maximum turn.
Figure 10:
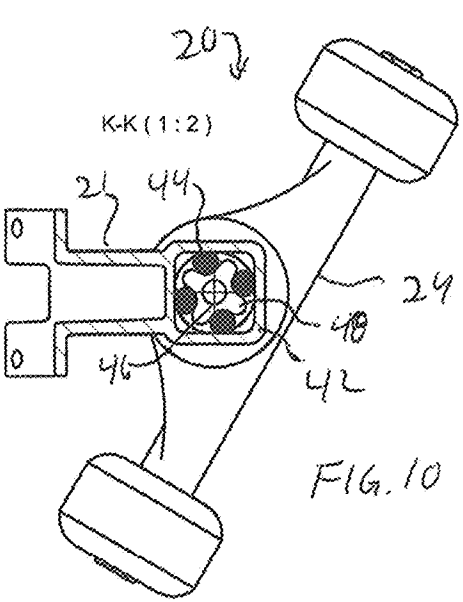
FIG. 10 is a sectional view of the truck in FIG. 5 at its maximum turn, taken along section line K-K in FIG. 5.

FIG. 9 is a perspective view of the truck 20 with the hanger 24 having a 30-degree turn in relation to the base assembly 21. Referring now to FIG. 10, the further turning of the hanger 24 causes the cam section 46 to turn further within the hollow housing 42. This in turn causes each of the walls 48 to further compress a respective one of the rods 44. In the embodiment shown, this 30-degrees of rotation can represent full turn and full compression of the rods 44. As mentioned above, when the turning force is removed, the rods 44 can expand and return the truck 20 to its neutral position.

Figures 11, 12, 13, 14, 15, 16:
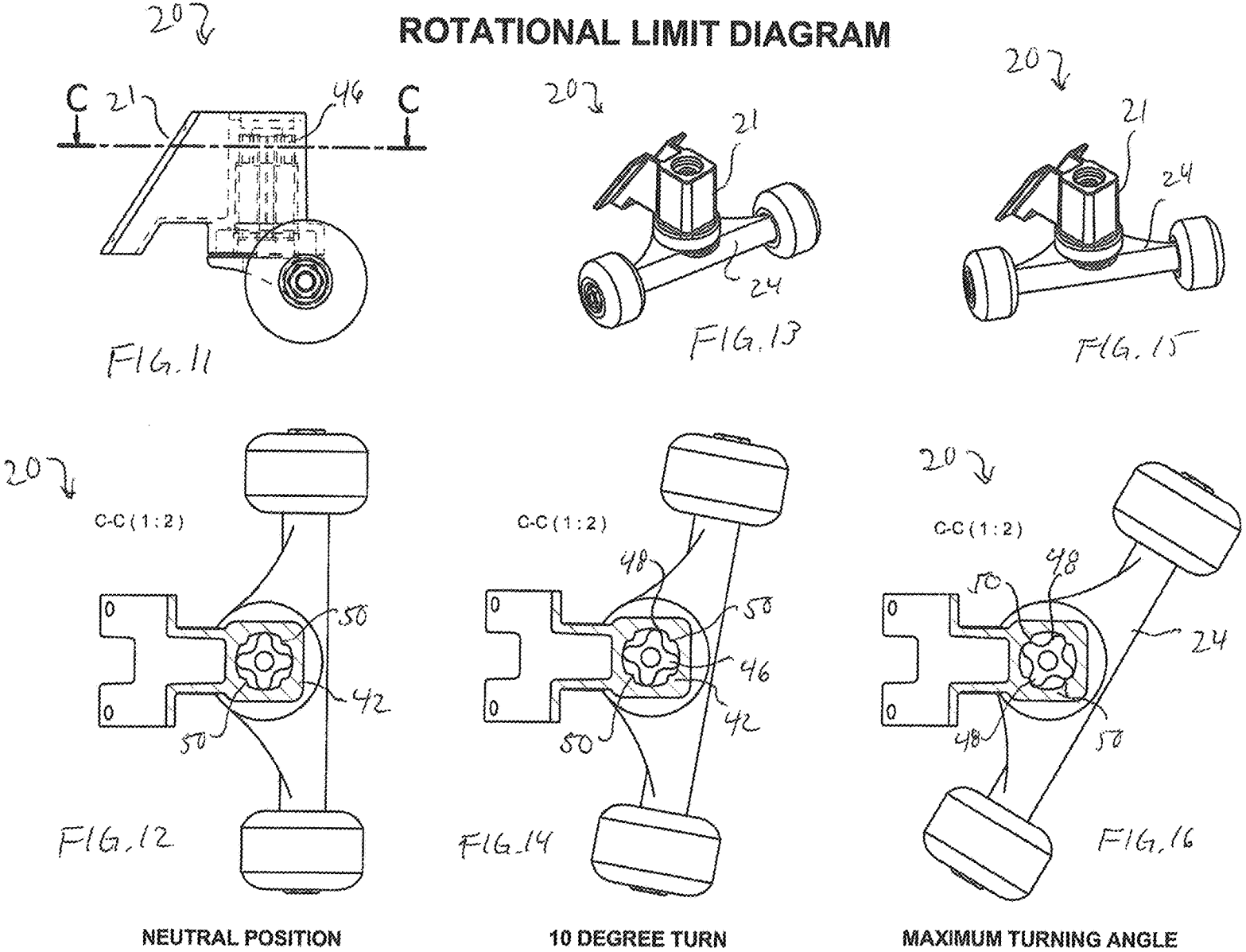
FIG. 11 is a side view of one embodiment of skateboard truck according to the present invention, with its internal or hidden components in phantom.
FIG. 12 is a top sectional view of the truck in FIG. 11 taken along second line C-C.
FIG. 13 is a perspective view of the truck in FIG. 11 at a 10-degree turn.
FIG. 14 is sectional view of the truck in FIG. 11 at a 10-degree turn, taken along section line C-C in FIG. 11.
FIG. 15 is a perspective view of the truck in FIG. 11 at its maximum turn.
FIG. 16 is a sectional view of the truck in FIG. 11 at its maximum turn, taken along section line C-C in FIG. 11.

Referring now to FIGS. 11-16, the turning action and stop of the trucks according to the present invention is shown in more detail. FIG. 11 is a side view of a truck 20 according to the present invention with a section line C-C through base assembly 21 and top portion of the cam section 46. The rods 44 shown in the figures above do not extend into this section of the truck but are instead arranged just below this section. FIG. 12 is a top section view of the truck 20 taken along section line C-C showing the truck 20 in its neutral position. This inside surface of the hollow housing 42 has four lateral protrusion 50 that are arranged as stops for the turning motion of the hanger 24 in relation to the base assembly 21.

FIG. 13 is a perspective view showing the truck 20 with the hanger 24 having a 10-degree turn in relation to the base assembly 21. Referring now to FIG. 14, the turning of the hanger 21 causes the cam section 46 to turn within the hollow housing 42. This in turn causes each of the walls 48 to move closer to one of the protrusions 50. FIG. 15 is a perspective view of the truck 20 with the hanger 24 having a 30-degree turn in relation to the base assembly 21. Referring now to FIG. 16, the further turning of the hanger 24 causes the walls 48 to hit one of the protrusions 50. This acts as stop (or maximum) turning point for the hanger 24 in relation to the base assembly 21.

The geometry will not allow the cam portion 46 to rotate any further, setting the stop turning radius at 30 degrees. This geometry allows maximum turning to occur at 30 degrees, while still not allowing the truck wheels to strike the underside of the skateboard deck when at this maximum turn. This will then prevent "wheel bite' to occur and eliminate this danger that is inherent in skateboards in general.

The rod and cam/wall system described above rolls and compresses the rods in a manner that is smoother, quieter and more gradual compared to a standard two bushing skateboard system in which are bushings are in simple compression. A standard skateboard truck pivots two points similar to a hammock, whereas this two-bearing rotation system in conjunction with the simultaneous rolling and compressing of the polyurethane rods offers a much smoother quieter turning mechanism. By positioning the more loosely turning front truck on the nose of the skateboard deck, in conjunction with a stiffer standard back truck mounted in a standard position, a skateboard is provided that has a closer feel to a surfboard and a low center of gravity and great stability. The skateboard can also be operated to self-propel, and is capable of do most of the flip tricks and aerials in bowls and street skating. The skateboard also like a surfboard at the moment that a common skateboard trucks bog down.

It will be apparent to those skilled in the art that various changes may be made without departing from the scope of the invention and the inventions not to be considered limited to what is shown and described in the specifications, drawings or figures. One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations of the scope. Changes therein and other uses will occur to those skilled in the art which are encompassed within the spirit of the invention. Although the invention has been described in connection with specific preferred embodiments it should be understood that the invention as claimed should not be unduly limited to such specific embodiments.

We claim:

1. A skateboard truck, comprising:

a hanger with wheels;

a base assembly, having an at least partially hollow housing section, wherein said hanger is rotationally mounted to said base assembly, with said hanger comprises an integrally formed cam that extends at least partially within said at least partially hollow housing section; and compressible spring elements within said at least partially hollow housing section, wherein said cam operates on said compressible spring elements when said hanger rotates in relation to said base assembly.

2. The truck of claim 1, wherein said cam compresses said compressible spring elements when said hanger rotates in relation to said base assembly.

3. The truck of claim 2, wherein said compressible spring elements are compressed between said cam and the inside surface of said hollow section.

4. The truck of claim 1, wherein said hanger has a neutral position in relation to said base assembly, wherein said hanger rotates in relation to said base assembly under a turning force, said truck returning to said neutral position when said turning force is removed.

5. The truck of claim 4, wherein expansion of said compressible spring elements causes said hanger to return to said neutral position.

6. The truck of claim 1, wherein said compressible spring elements comprise a plurality of compressible rods.

7. The truck of claim 6, wherein said cam comprises walls to compress said rods when said hanger rotates in relation to said base assembly.

8. The truck of claim 1, wherein said base assembly comprises an angled base plate.

9. A skateboard truck, comprising:

a hanger with wheels;

a base assembly, having an at least partially hollow housing section, wherein said hanger is rotationally mounted to said base assembly, with said hanger comprises a hanger portion within said at least partially hollow housing section; and compressible spring elements within said at least partially hollow housing section, wherein said hanger portion operates on said compressible spring elements when said hanger rotates in relation to said base assembly, wherein said hollow section comprises one or more protrusions to limit rotation of said hanger portion within said hollow section.

10. A skateboard truck, comprising;

a hanger rotatably mounted to a base assembly, wherein said hanger comprises an integrally formed cam arranged at least partially internal to said base assembly; and spring elements internal to said base assembly and arranged to cooperate with said cam, wherein a turning force on said hanger causes said hanger and said cam to rotate in relation to said base assembly, which causes compression of said internal spring elements, and wherein removal of said turning force allows said spring elements to expand to cause said hanger and said cam to return to a neutral position in relation to said base assembly.

11. The truck according to claim 10, wherein said base assembly comprises a hollow section holding said spring elements, and wherein said cam compresses said spring elements when said hanger rotates in relation to said base assembly.

12. The truck of claim 11, wherein said compressible spring elements are compressed between said cam and the inside surface of said hollow section.

13. The truck of claim 11, wherein said cam compresses said spring elements with said hanger rotates in relation to said base assembly.

14. The truck of claim 10, wherein said spring elements comprise a plurality of compressible rods.

15. The truck of claim 10, wherein said base assembly comprises an angled base plate.

16. A skateboard truck, comprising;

a hanger rotatably mounted to a base assembly; and spring elements internal to said base assembly, wherein a turning force on said hanger causes said hanger to rotate in relation to said base assembly, which causes compression of said internal spring elements, and wherein removal of said turning force allows said spring elements to expand to cause said hanger to return to a neutral position in relation to said base assembly, wherein said base assembly comprises a hollow section holding said spring elements, and wherein said hanger compresses said spring elements when said hanger rotates in relation to said base assembly and wherein said hollow section comprises one or more protrusion to limit rotation of said hanger portion within said hollow section.

17. A skateboard, comprising:

a skateboard deck;

a truck mounted to said skateboard deck, said truck comprising a hanger and a base assembly having an at least partially hollow housing section, wherein said hanger comprises an integrally formed cam that extends at least partially within said at least partially hollow housing section, and said hollow section further comprises internal compressible spring elements that are compressed when turning said skateboard, said internal compressible spring elements expanding and returning said truck to a neutral position when said skateboard is not turning.

18. The skateboard of claim 17, wherein said compressible spring elements comprise a plurality of compressible rods.

19. The skateboard of claim 18, wherein said truck comprises a turn limit to limit the extent to which said truck can turn.

* * * * *